US006091915A

United States Patent [19]

Takagishi

[11] Patent Number: 6,091,915

[45] **Date of Patent: *Jul. 18, 2000**

[54] IMAGE FORMING APPARATUS WITH INDEPENDENT DISPLAYS

[75] Inventor: Hiroaki Takagishi, Kashiwa, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/744,378

[22] Filed: Nov. 7, 1996

[30] Foreign Application Priority Data

Nov. 10, 1995 [JP] Japan ..... 7-292742

[51] Int. Cl.[7] ..... G03G 15/00

[52] U.S. Cl. ..... 399/81; 399/21

[58] Field of Search ..... 399/81, 11, 10, 399/8–9, 18, 21, 24–25, 124, 381; 395/100; 364/927.2, 927.66, 927.7, 927.92, 930; 345/903, 905

[56] References Cited

U.S. PATENT DOCUMENTS

| | | | |
|---|---|---|---|
| 3,655,283 | 4/1972 | Margulis et al. | 399/21 |
| 4,551,000 | 11/1985 | Kanemitsu et al. | 399/10 |
| 4,908,655 | 3/1990 | Takagi | 399/21 X |
| 4,937,036 | 6/1990 | Beard et al. | 364/927.2 X |
| 4,996,557 | 2/1991 | Takagi | 399/21 X |
| 5,038,169 | 8/1991 | Marincic et al. | 399/124 |
| 5,077,582 | 12/1991 | Kravette et al. | 399/8 |
| 5,111,243 | 5/1992 | Hatano | 399/81 |
| 5,243,382 | 9/1993 | Takano et al. | 399/8 |
| 5,367,363 | 11/1994 | Kai et al. | 399/113 |
| 5,602,625 | 2/1997 | Okamoto et al. | 399/21 |
| 5,758,224 | 5/1998 | Binder et al. | 399/25 |

FOREIGN PATENT DOCUMENTS

| | | |
|---|---|---|
| 2-39077 | 2/1990 | Japan . |
| 5-294547 | 11/1993 | Japan . |
| 7-184005 | 7/1995 | Japan . |
| 8039894 | 2/1996 | Japan . |

*Primary Examiner*—Quana Grainger
*Attorney, Agent, or Firm*—Fitzpatrick, Cella, Harper & Scinto

[57] ABSTRACT

An image forming apparatus includes an image forming portion disposed within a main body of the apparatus to form an image, a first display attached to an upper portion of the main body to display information regarding the handling of the apparatus, and an open/close mechanism provided on a frame of the main body to be openable opened during the maintenance. In addition, a second display mechanism is disposed at a position viewable by an operator from a position where the open/close mechanism is opened and includes a single display for selectively displaying a plurality of information data.

11 Claims, 7 Drawing Sheets

IMAGE FORMING APPARATUS WITH INDEPENDENT DISPLAYS

BACKGROUND OF THE INVENTION

1. Field of the Invention

The present invention relates to an image forming apparatus such as a laser beam printer having a display apparatus such as an LCD display (liquid crystal display) of interactive type.

2. Related Background Art

In recent years, in image forming apparatuses such as copying machines, laser beam printers and the like, in consideration of a sheet jam treatment performed by an operator, a large LCD display of interactive type which also acts as an operation panel in an operation portion has been used so that treatment procedures are presented to the operator in an animation fashion.

By the way, in the conventional image forming apparatus having such an LCD display, the LCD display was disposed in an operation panel portion on an upper surface of the apparatus. When the jam treatment is actually being effected, since the operator stoops or looks down, the animation display on the LCD display disposed on the upper surface of the apparatus disappears from the operator's view, with the result that the operator cannot perform the jam treatment while referring to the animation display.

SUMMARY OF THE INVENTION

The present invention intends to eliminate the above-mentioned conventional drawback, and have an object to provide an image forming apparatus in which operability is enhanced by permitting an operator to watch an explanation for handling the apparatus and a portion to be handled simultaneously.

Another object of the present invention is to provide an image forming apparatus which can achieve the above object without maintenance effected by an expert and without making the apparatus bulky.

To achieve the above object, an electrophotographic image forming apparatus according to the present invention comprises an image forming portion disposed within the apparatus to form an image, a first display means attached to an upper portion of the apparatus to display information regarding the handling of the apparatus, an open/close means provided on a frame of the apparatus and capable of being opened during maintenance, and a second display means disposed at a position which can be looked at by an operator from a position where the open/close means is opened and including a single display means for selectively displaying a plurality of information data.

DETAILED DESCRIPTION OF THE PREFERRED EMBODIMENTS

The present invention will now be explained with reference to the accompanying drawings.

First of all, a construction of an image forming apparatus will be briefly explained with reference to FIG. 6.

The image forming apparatus is embodied as an electrophotographic copying machine. The copying machine 50 is provided at its upper portion with an operation panel (operation portion) 51 on which various operation buttons and a first LCD display device 10 (refer to FIG. 5) (with its LCD display surface 11 facing upside) are disposed. Further, an automatic original feeder 52 is disposed on the copying machine 50.

Figure 5:
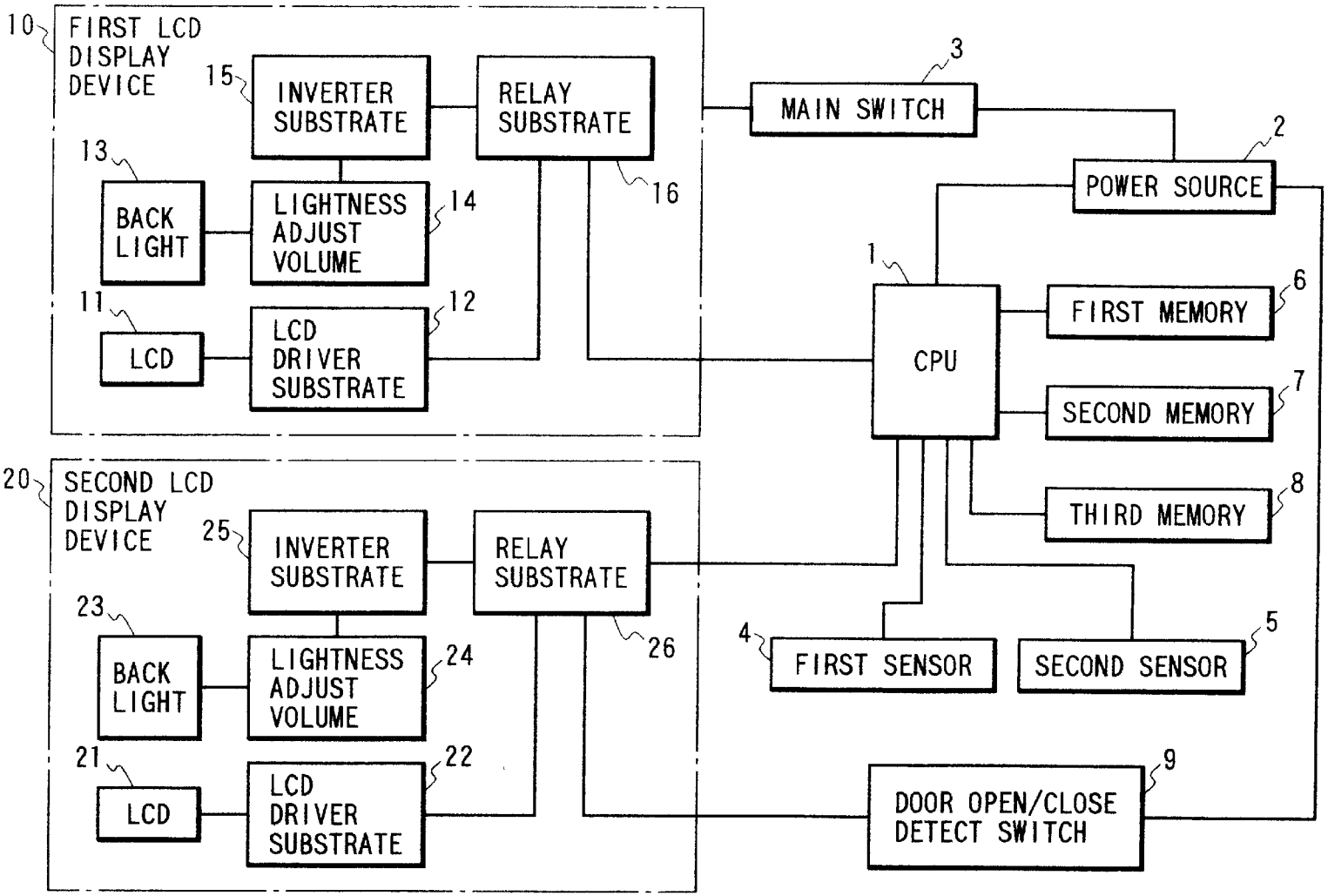
FIG. 5 is an electric circuit diagram of the LCD display of the image forming apparatus.

Incidentally, as shown in FIG. 5, the first LCD display device 10 disposed outside the copying machine 50 comprises the above-mentioned LCD 11, an LCD driver substrate 12 for driving the LCD 11, a back light 13 for the LCD 11, a brightness adjust volume 14 for adjusting brightness of the back light 13, an inverter substrate 15 for controlling the back light 13, and a relay substrate 16 for electrically connecting the inverter substrate 15 and the LCD driver substrate 12 to a CPU 1 and a power source 2. A main switch 3 is disposed between the relay substrate 16 and the power source 2. Not only the power source 2 and the main switch 3 but also first and second sensors 4, 5 are electrically connected to the CPU 1 which includes first, second and third memories 6, 7 and 8 therein.

Figure 7:
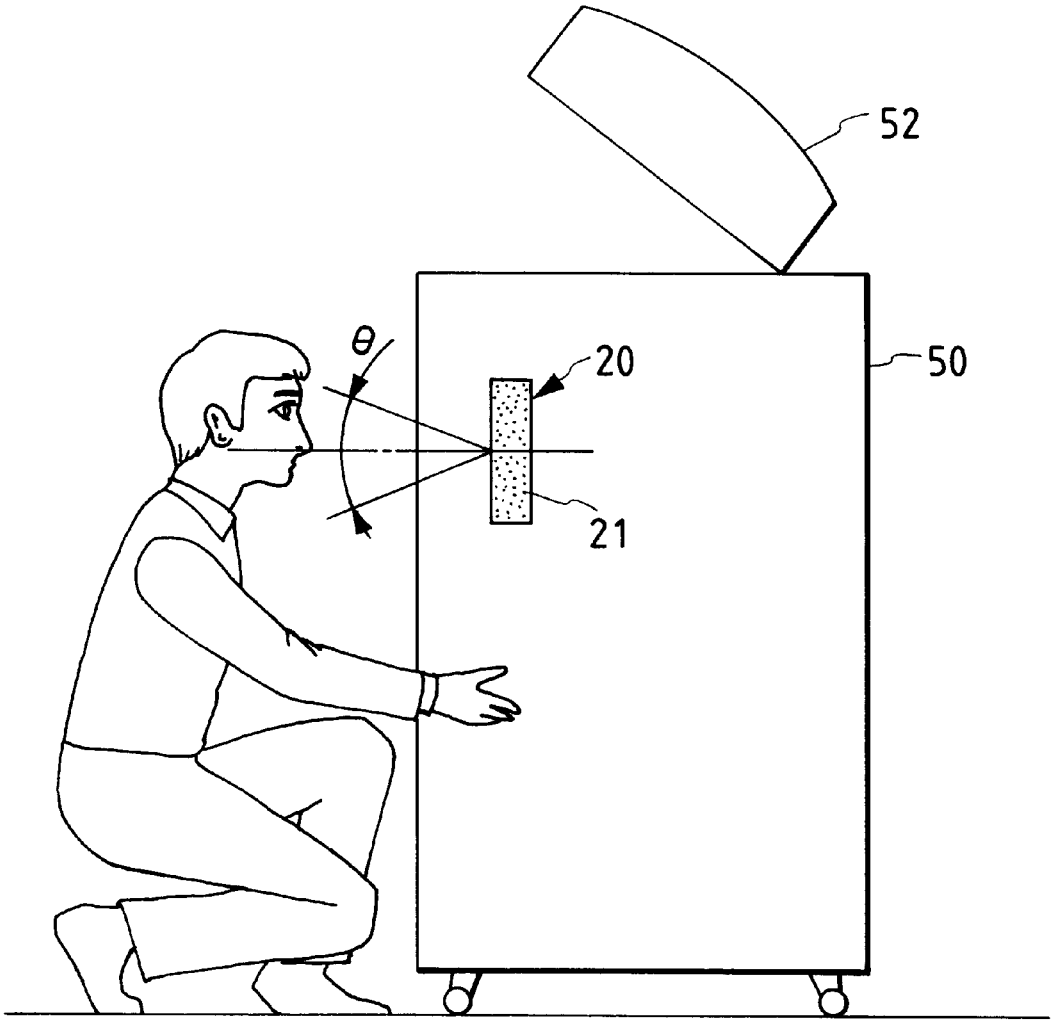
FIG. 7 is a side view showing an operator's posture with respect to the image forming apparatus in a jam treatment.

Within the copying machine 50, a second LCD display device 20 is disposed below the operation panel 51, and a rectangular LCD 21 constituting a display surface of the second LCD display device 20 faces a front side through a rectangular opening 53*a* formed in an inner cover 53. In a normal condition, i.e. a condition that a front door (not shown) is closed, the LCD 21 cannot be seen from the outside. The LCD 21 has an angle of view different from that of the LCD 11 of the first LCD display device 10, and the angle of view of the LCD 21 is selected to θ in consideration of a viewing point of the operator who is performing the jam treatment, as shown in FIG. 7.

Further, a fixing device 54 for fixing a toner image (transferred to a transfer sheet) onto the transfer sheet is disposed at a discharge side of the copying machine 50. Below the fixing device 54, there are disposed an intermediate tray 55 for temporarily storing the transfer sheets (the image was formed on one surface of each transfer sheet) in a both-face copy mode, a both-face convey portion 56 for conveying the transfer sheets (the image was formed on one surface of each transfer sheet) to the intermediate tray 55 in the both-face copy mode, a convey portion 57 for conveying the transfer sheet after development, and a paper deck 58 for containing the copied sheets. Incidentally, the reference numeral 27 denotes a side plate.

Next, a construction of the second LCD display device 20 will be fully explained with reference to FIGS. 1, 2, 3, 4 and 5.

As shown in FIG. 5, similar to the first LCD display device 10, the second LCD display device 20 comprises the above-mentioned LCD 21, an LCD driver substrate 22 for driving the LCD 21, a back light 23 for the LCD 21, a brightness adjust volume 24 for adjusting brightness of the back light 23, an inverter substrate 25 for controlling the back light 23, and a relay substrate 26 for electrically connecting the inverter substrate 25 and the LCD driver substrate 22 to the CPU 1 and the power source 2. A door open/close detect switch 9 is disposed between the relay substrate 26 and the power source 2.

Figure 1:
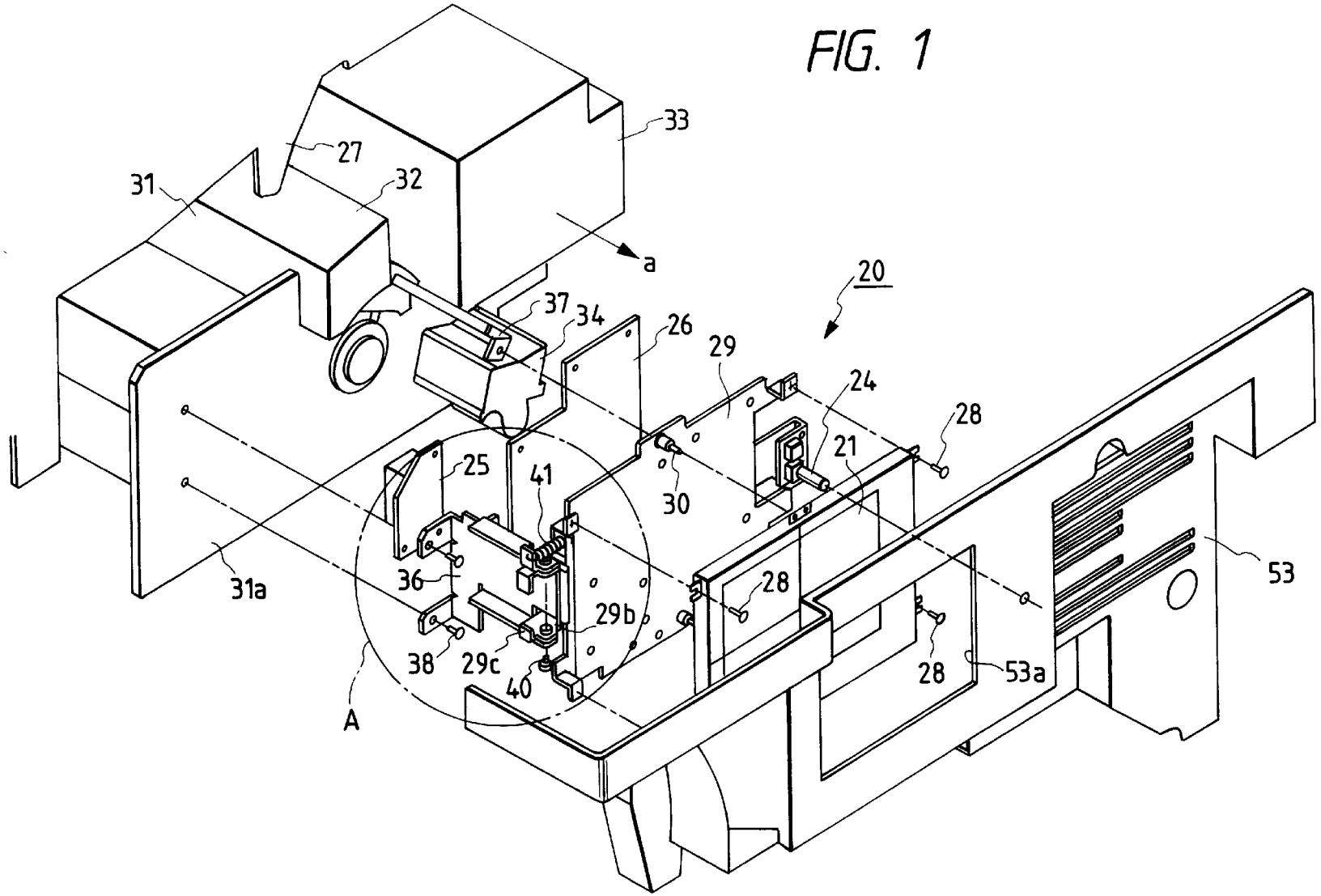
FIG. 1 is an exploded perspective view of an LCD display portion of an image forming apparatus according to the present invention.
Figure 3:
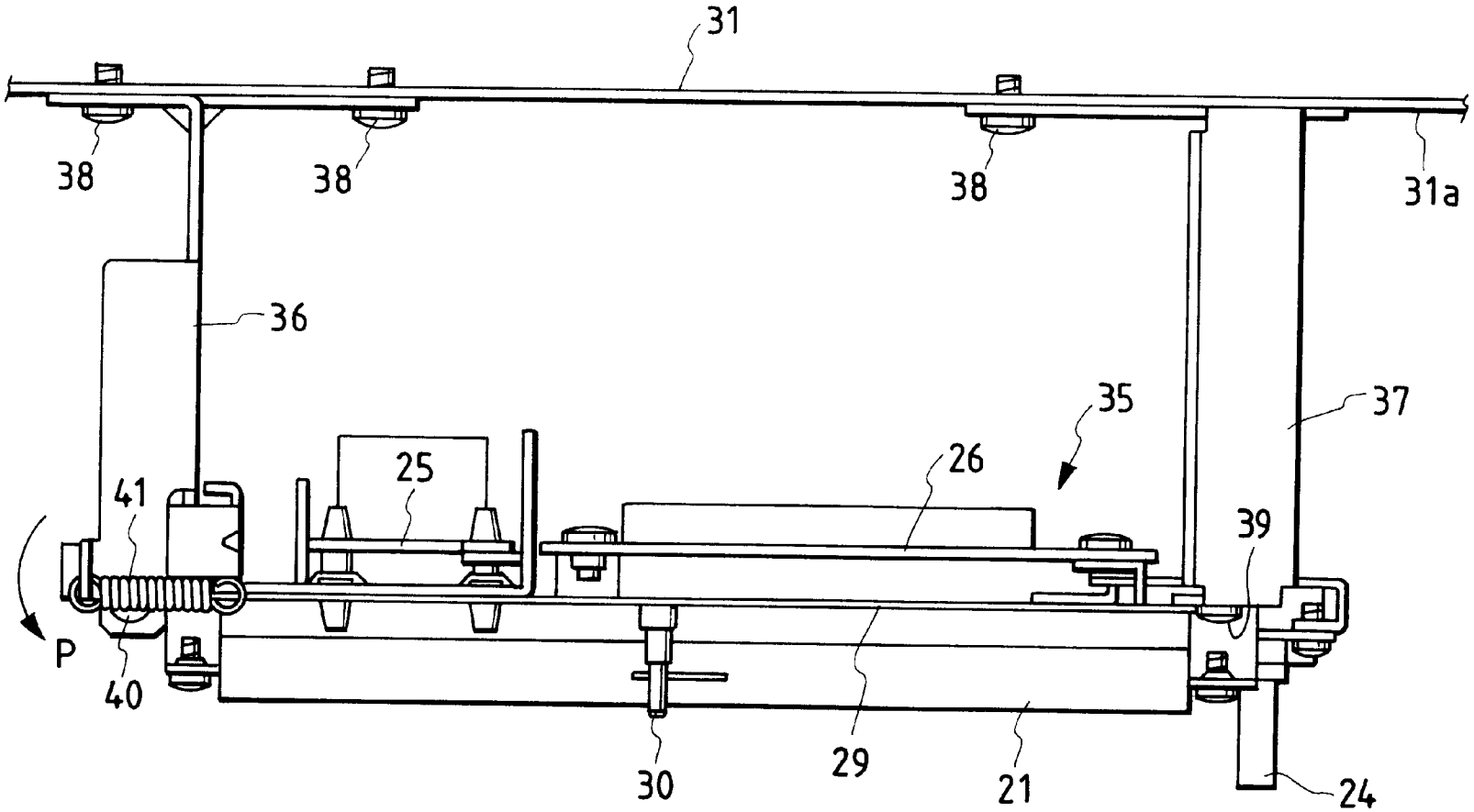
FIG. 3 is a plan view of the LCD display in a normal condition.

The LCD 21 serves to present information regarding treating procedures to the operator in an interactive animation display fashion, for example, when the sheet jam occurs. As shown in FIGS. 1 and 3, the LCD 21 is attached to a front surface of an LCD support plate 29 by a plurality of screws 28. As shown in FIG. 1, a pin 30 for positioning the LCD is secured to the LCD support plate 29 by caulking, and the LCD support plate 29 is provided with an attachment portion 29*a* for attaching the brightness adjust volume 24, a hinge portion 29*b* for rotating the LCD 21 together with the LCD support plate 29, and a rotational amount regulating portion (stopper portion) 29*c*.

As shown in FIG. 3, the inverter substrate 25 and the relay substrate 26 are attached to a back surface of the LCD support plate 29 via screws and card spacers.

On the other hand, an AP kit unit 31 for supporting a photosensitive drum (not shown) is removably mounted on the side plate 27 so that the AP kit unit 31 can be retracted or drawn out toward a front side when the maintenance is performed. Incidentally, in FIG. 1, the reference numeral 32 denotes a first charger for applying uniform voltage to the photosensitive drum before a latent image is exposed; 33 denotes a developing device for developing the latent image formed on the photosensitive drum to form a toner image; and 34 denotes a pre-transfer charger for controlling correction of potential of the toner image and the photosensitive drum.

Figure 2:
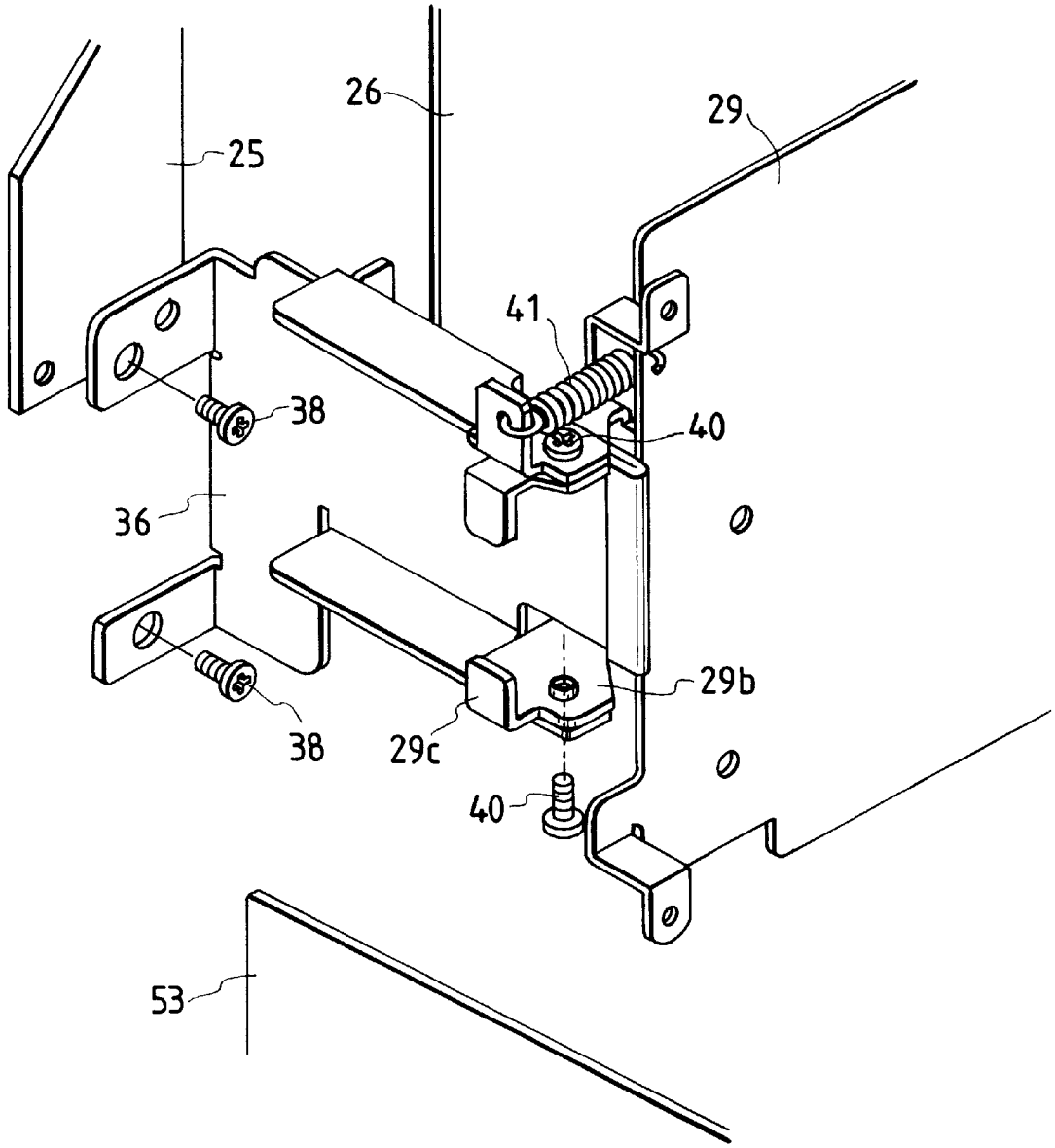
FIG. 2 is an enlarged view showing a portion within a circle A in FIG. 1.

As shown in FIG. 3, an LCD support plate unit 35 constituted by the LCD support plate 29 and the inverter substrate 25 and relay substrate 26 (which elements 25, 26 are attached to the LCD support plate) is attached to a side plate 31*a* of the AP kit unit 31 via two support members 36, 37. That is to say, the support members 36, 37 are attached to the side plate 31*a* by screws 38, one end (right end in FIG. 3) of the LCD support plate unit 35 is secured to the support member 37 by screws 39, and the other end (left end in FIG. 3) of the LCD support plate unit 35 is pivotally connected to the support member 36 by screws 40 for horizontal rotational movement, as shown in FIG. 2. A toggle spring 41 is disposed between the LCD support plate unit 35 and the support member 37 so that the LCD support plate unit 35 can be biased toward a direction P (closing direction) in FIG. 3 and a direction Q (opening direction) in FIG. 4.

Figure 6:
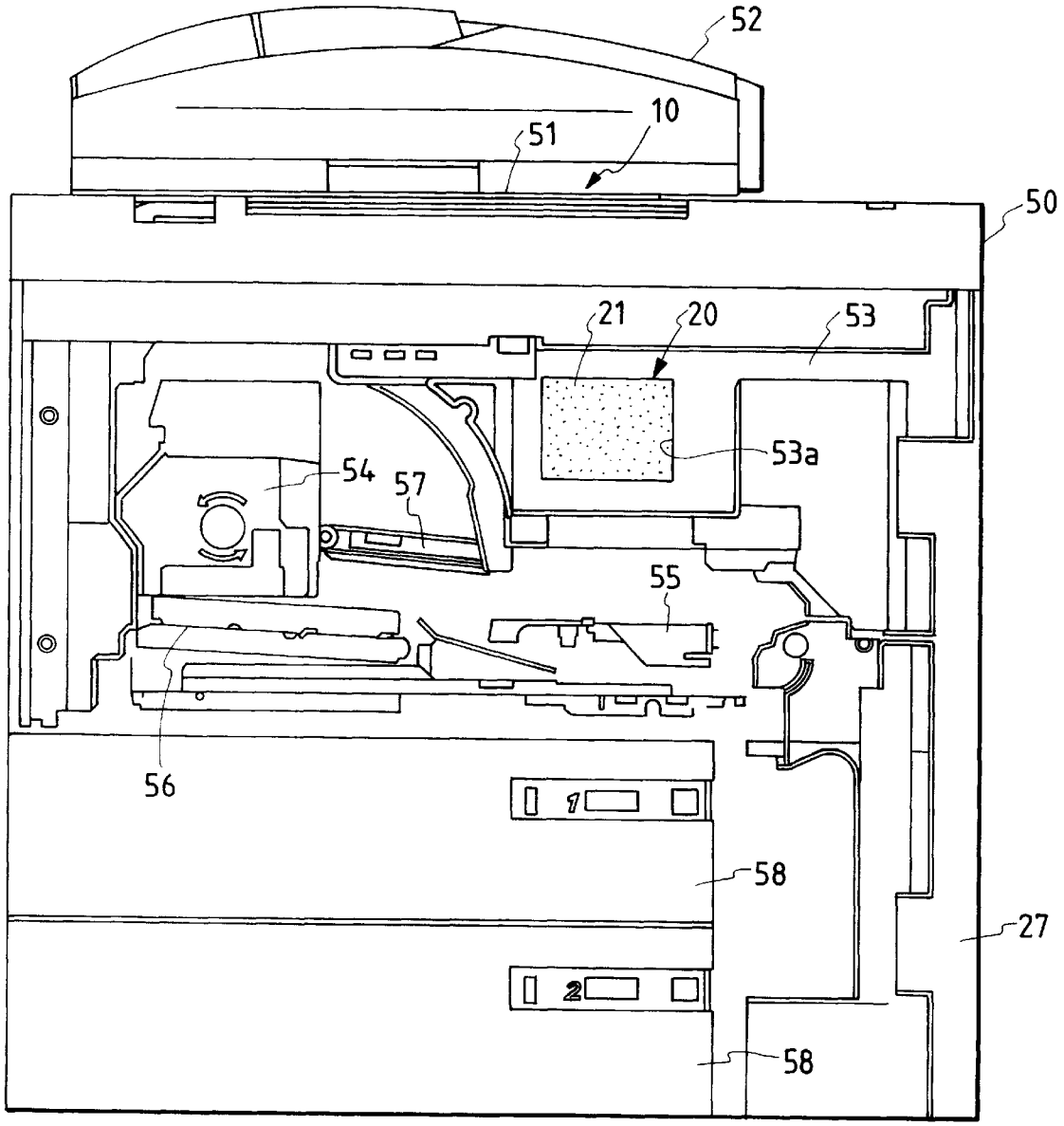
FIG. 6 is a front view of the image forming apparatus with a front door removed.

The second LCD display device 20 having the above-mentioned construction is disposed within the copying machine 50 with the LCD 21 facing toward the front side, as shown in FIG. 6.

In the image forming apparatus according to the illustrated embodiment, when the main switch 3 is turned ON, a signal from the CPU 1 and electric power from the power source 2 are supplied to the LCD 11 of the first LCD display device 10 and the back light 13 through the relay substrate 16 to drive the LCD and the back light, with the result that various information data for operation are displayed on the LCD 11. For example, if the sheet jam occurs during the copying operation, when the front door is opened by the operator to effect the jam treatment, the door open/close detect switch 9 is turned ON. This causes a signal from the CPU 1 and the electric power from the power source 2 to be supplied to the LCD 21 of the second LCD display device 20 and the back light 23 through the relay substrate 26 to drive the LCD and the back light, with the result that the procedures for jam treatment are displayed on the LCD 21 in the animation fashion. In this case, as mentioned above, since LCD 21 has the angle of view different from that of the LCD 11 of the first LCD display device 10 and the angle of view of the LCD 21 is selected to θ in consideration of a viewing point of the operator who is performing the jam treatment as shown in FIG. 7, even when the sheet jam occurs at any position in a sheet supply portion, the operator can perform the jam treatment while watching the displayed contents on the LCD 21 without changing his posture.

As shown in FIG. 5, since the LCD 11 of the first LCD display device 10 and the LCD 21 of the second LCD display device 20 are connected to the CPU 1 independently, signals emitted from the first to third memories 6 to 8 and sent through the CPU 1 are received by the LCDs 11, 21 independently. Further, on the basis of detection signals from the first and second sensors 4, 5 connected to the CPU 1, the CPU 1 determines which information from the first, second or third memory 6, 7 or 8 should be outputted to the LCD 21 of the second LCD display device 20. Further, since the first and second LCD display devices 10, 20 have the brightness adjust volumes 14, 24, respectively, the brightness of the LCD 11 and the brightness of the LCD 21 can be adjusted independently.

Next, the procedures of the service maintenance will be explained with reference to FIGS. 1, 3 and 4.

For example, when the maintenance of the developing device 33 is performed, the developing device 33 must be retracted toward a direction a in FIG. 1 (toward the front side). However, in the normal condition, since the LCD support plate unit 35 positioned at a first position interferes with the developing device, the developing device 33 cannot be retracted. To avoid this, after the screws 39 are unthreaded to release the one end of the LCD support plate unit 35 from the support member 37, as shown in FIG. 4, the other end of the LCD support plate unit 35 is rotated from the first position around the screws 40 to open or shift the LCD support plate unit 35 to a second position, thereby retracting the LCD support plate unit 35 from a developing device retracting path.

Figure 4:
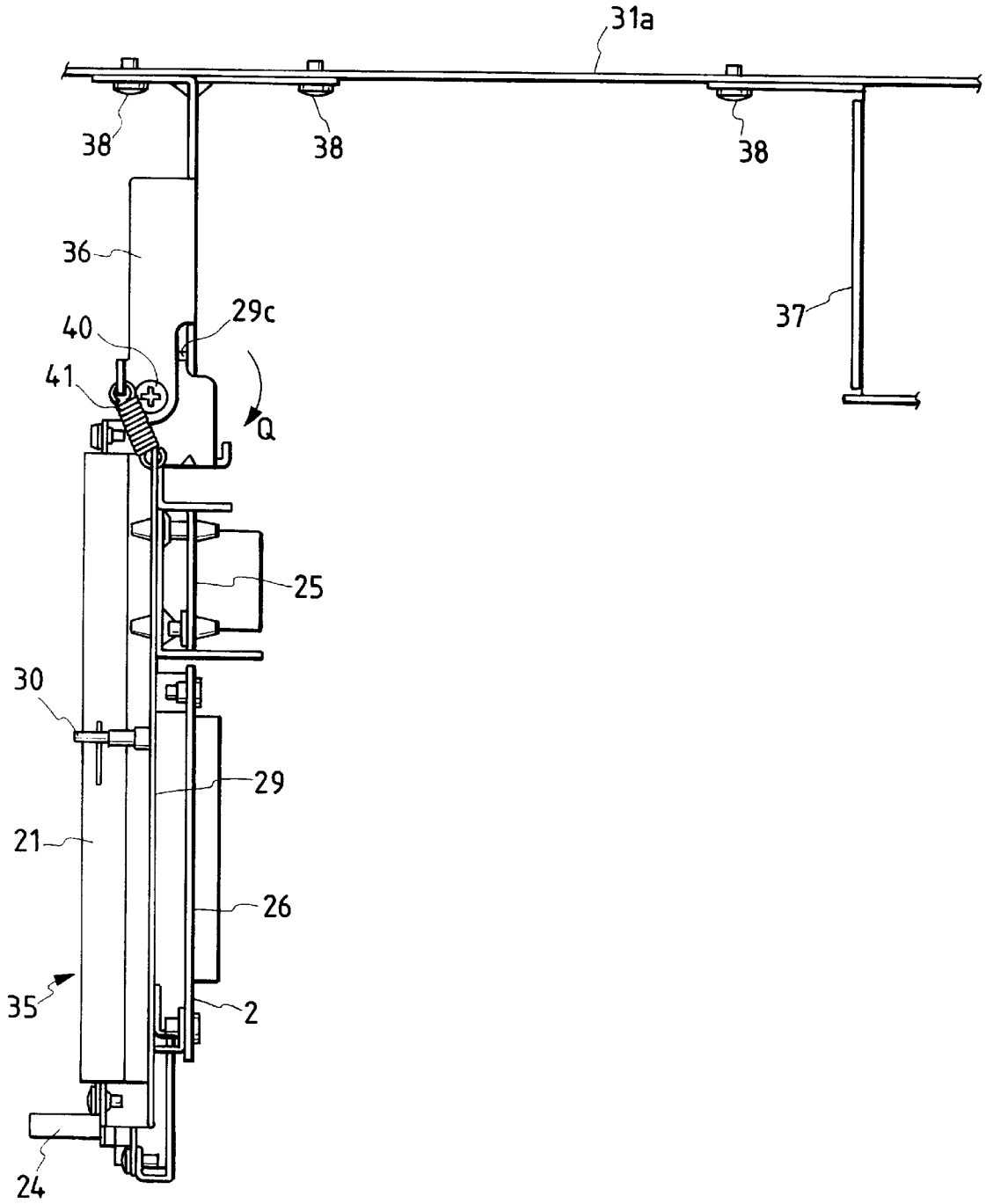
FIG. 4 is a plan view of the LCD display in a maintenance condition.

In this case, since the LCD support plate unit 35 is biased toward the direction Q (opening direction) by the toggle spring 41 to be held at the position shown in FIG. 4, when the developing device 33 is retracted, there is no need for the operator to hold the LCD support plate unit 35, and the LCD support plate unit 35 does not interfere with such maintenance. Further, in this case, since the rotational amount regulating portion 29 provided on the LCD support plate 29 abuts against a side surface of the support member 36 by torque generated by the toggle spring 41, it acts as a stopper for regulating the rotational amount of the LCD support plate unit 35.

As mentioned above, when the LCD support plate unit 35 is shifted from the first position to the second position to be retracted from the developing device retracting path, the developing device 33 can easily be retracted without interference with the LCD support plate unit 35. In this way, since the LCD support plate unit 35 can be retracted from the developing device retracting path on demand, the LCD support plate unit 35 can be disposed in any unit retracting path, thereby making the image forming apparatus compact.

As mentioned above, according to one embodiment of the present invention, the second LCD display device having the angle of view different from that of the first LCD display device provided on the upper surface of the apparatus is disposed therein. Thus, the operator can see the displayed contents on the second LCD display device and the portion of the apparatus to be handled simultaneously, with the result that the operability of the image forming apparatus can be improved.

Further, according to another embodiment of the present invention, the second LCD display device can be retracted from any unit retracting path. Thus, in the maintenance, the second LCD display device does not interfere with the maintenance, and since the second LCD display device does not occupy an exclusive space, the image forming apparatus can be made compact.

Incidentally, while an example that the LCD display devices are used as the first and second display devices was explained, it should be noted that such display devices may be constituted by other display devices. For example, a plasma display or a CRT tube can be used as the display device.

What is claimed is:

1. An image forming apparatus comprising:

a main body;

an open/close portion provided on said main body to be able to open said main body during jam processing of a sheet;

a photosensitive body disposed within said main body;

a toner image forming portion disposed within said main body for forming a toner image on said photosensitive body;

a transferring portion disposed within said main body for transferring the toner image on said photosensitive body to the sheet;

a fixing portion disposed within said main body for fixing the toner image on the sheet to the sheet;

a convey path disposed within said main body for conveying a sheet between said transferring portion and said fixing portion; and a first display portion disposed within said main body and facing said open/close portion for displaying information regarding the jam processing of the sheet, wherein said first display portion covers said open/close portion side of said toner image portion while said first display portion does not cover said open/close portion side of said convey path.

2. An image forming apparatus according to claim 1, further comprising a second display portion different from said display portion and located outside of said main body for displaying information regarding an image forming operation of said apparatus.

3. An image forming apparatus according to claim 1, wherein said display portion comprises an LCD.

4. An image forming apparatus according to claim 1, wherein a frame supporting said photosensitive body can be pulled out from said apparatus, and said display portion is attached to said frame.

5. An image forming apparatus comprising:

a main body;

a photosensitive body disposed within said main body;

a toner image forming portion disposed within said main body nearby said photosensitive body for forming a toner image on said photosensitive body;

an opening provided for detaching said toner image forming portion during maintenance of said toner image forming portion;

a transferring portion disposed within said main body for transferring the toner image on said photosensitive body to a sheet;

a fixing portion disposed within said main body for fixing the toner image on the sheet to the sheet; and a first display portion disposed within said main body for displaying information regarding jam processing of the sheet, wherein said display portion is provided so as to cover said opening.

6. An image forming apparatus according to claim 5, wherein said display portion is secured by a securing member and, when said securing member is detached, said display portion moves and said opening is opened.

7. An image forming apparatus according to claim 5, wherein said toner image forming portion moves along said photosensitive body to be pulled out from said opening.

8. An image forming apparatus according to claim 5, wherein a second display portion different from said first display portion is located outside of said main body for displaying information regarding an image forming operation of said apparatus.

9. An image forming apparatus according to claim 5, wherein said first display portion comprises an LCD.

10. An image forming apparatus according to claim 5, further comprising a frame supporting said photosensitive body, wherein said frame can be pulled out from said apparatus, and said first display portion is attached to said frame.

11. An image forming apparatus according to claim 5, wherein said toner image forming portion is a developing portion for supplying toner to said photosensitive body.

* * * * *

UNITED STATES PATENT AND TRADEMARK OFFICE

CERTIFICATE OF CORRECTION

PATENT NO. : 6,091,915

DATED : July 18, 2000

INVENTOR(S): HIROAKI TAKAGISHI

It is certified that error appears in the above-identified patent and that said Letters Patent is hereby corrected as shown below:

[56] REFERENCES CITED:

FOREIGN PATENT DOCUMENTS, "8039894" should read --8-039894--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*